US009388977B2

(12) United States Patent
Yamada et al.

(10) Patent No.: US 9,388,977 B2
(45) Date of Patent: Jul. 12, 2016

(54) BOILER SYSTEM

(71) Applicant: Miura Co., Ltd., Ehime (JP)

(72) Inventors: Kazuya Yamada, Ehime (JP); Koji Miura, Ehime (JP)

(73) Assignee: MIURA CO., LTD, Matsuyama-Shi, Ehime (JP)

( * ) Notice: Subject to any disclaimer, the term of this patent is extended or adjusted under 35 U.S.C. 154(b) by 0 days.

(21) Appl. No.: 14/416,578

(22) PCT Filed: Oct. 29, 2013

(86) PCT No.: PCT/JP2013/079192

§ 371 (c)(1),
(2) Date: Jan. 22, 2015

(87) PCT Pub. No.: WO2014/132489

PCT Pub. Date: Sep. 4, 2014

(65) Prior Publication Data

US 2015/0267914 A1 Sep. 24, 2015

(30) Foreign Application Priority Data

Feb. 28, 2013 (JP) ..... 2013-038922

(51) Int. Cl.
*F22B 35/18* (2006.01)
*F22B 37/38* (2006.01)
*F22B 35/00* (2006.01)

(52) U.S. Cl.
CPC ..... *F22B 35/18* (2013.01); *F22B 35/008* (2013.01); *F22B 37/38* (2013.01)

(58) Field of Classification Search
CPC ..... F22B 35/008; F22B 35/18; F22B 37/38
USPC ..... 122/448.1, 448.3, 14.3, 447, 448.2, 122/448.4, 449
See application file for complete search history.

(56) References Cited

U.S. PATENT DOCUMENTS 7,819,334 B2 * 10/2010 Pouchak ..... F23N 5/00 122/448.1
8,888,011 B2 11/2014 Miura et al.
2011/0162593 A1 * 7/2011 Miura ..... F22B 35/00 122/448.1

(Continued)

FOREIGN PATENT DOCUMENTS

CN 101093075 A 12/2007
CN 102343276 A 1/2012

(Continued)

*Primary Examiner* — Alissa Tompkins
*Assistant Examiner* — Benjamin W Johnson
(74) *Attorney, Agent, or Firm* — Muncy, Geissler, Olds & Lowe, P.C.

(57) ABSTRACT

A boiler group includes a plurality of boilers. Each of the boilers has a unit amount of steam and a maximum variable amount of steam. A controller includes a deviation calculator for calculating a deviation amount between a necessary amount of steam and an output amount of steam, a boiler selector for selecting the plurality of boilers in order of load factors, and an output controller for varying an amount of steam of a boiler selected first by the boiler selector by the maximum variable amount of steam—when the deviation amount is at least the—maximum variable amount of steam, and varying the amount of steam of the first selected boiler by the unit amount of steam for the deviation amount when the deviation amount is less than the maximum variable amount of steam.

17 Claims, 9 Drawing Sheets

(56) References Cited

U.S. PATENT DOCUMENTS

| | | | | |
|---|---|---|---|---|
| 2011/0238216 | A1* | 9/2011 | Yamada | F01K 13/02 700/274 |
| 2012/0006285 | A1 | 1/2012 | Miura et al. | |

FOREIGN PATENT DOCUMENTS

| | | | |
|---|---|---|---|
| JP | 11-132405 | A | 5/1999 |
| JP | 2008-241105 | | 10/2008 |
| JP | 2010-048462 | | 3/2010 |

* cited by examiner

BOILER SYSTEM

TECHNICAL FIELD

The present invention relates to a boiler system. The present invention more particularly relates to a boiler system for proportionally controlling a combustion state. This application claims a priority right on the basis of JP 2013-038922 filed on Feb. 28, 2013 in Japan and its content is incorporated herein by reference.

BACKGROUND ART

Conventionally proposed boiler systems for combusting a plurality of boilers to generate steam include a boiler system of the so-called proportional control type, for continuously increasing or decreasing a boiler combustion amount to control a steam flow.

For example, Patent Document 1 proposes a control method for proportional control boilers, of operating a plurality of combusting boilers at equivalent load factors, and operating respective combusting boilers at equivalent load factors after the number of combusting boilers varies.

PRIOR ART DOCUMENT

Patent Document

Patent Document 1: JP 11-132405 A

SUMMARY OF INVENTION

Problem to be Solved by the Invention

The technique proposed in Patent Document 1 causes variations of the load factors of respective combusting boilers each time a necessary steam flow varies and each time the number of boilers to be combusted varies. In this case, combustion states of the respective combusting boilers change frequently and pressure of the boiler system is thus hard to be kept stably.

In view of the above problem, an object of the present invention is to provide a boiler system that can equalize load factors of a plurality of boilers without varying steam flows of all the boilers each time a necessary steam flow varies.

Solution to Problem

The present invention relates to a boiler system provided with a boiler group including a plurality of boilers configured to combust at continuously changing load factors, and a controller for controlling a combustion state of the boiler group in accordance with a required load, wherein each of the boilers has a unit steam flow set as a unit of a variable steam flow and a maximumly varied steam flow set as an upper limit value of a variable steam flow per unit time, the controller includes a deviation calculator for calculating a deviation amount between a necessary steam flow required in accordance with the required load and an output steam flow outputted from the boiler group, a boiler selector for selecting the plurality of boilers in an order of lower or higher load factors, a determiner for determining whether or not the deviation amount is at least the maximumly varied steam flow, and an output controller for varying the steam flow of the boiler selected first by the boiler selector by the unit steam flow for an amount corresponding to the maximumly varied steam flow when the determiner determines that the deviation amount is at least the maximumly varied steam flow, and varying the steam flow of the selected boiler by the unit steam flow for an amount corresponding to the deviation amount when the determiner determines that the deviation amount is less than the maximumly varied steam flow.

Preferably, when the determiner determines that the deviation amount is at least the maximumly varied steam flow, the output controller varies the steam flow of the boiler selected subsequently to the first selected boiler by the unit steam flow for an amount corresponding to a difference between the deviation amount and the maximumly varied steam flow.

Preferably, the maximumly varied steam flow includes a maximumly increased steam flow as an upper limit value of the steam flow possibly increased per unit time, the determiner determines whether or not the necessary steam flow is larger than the output steam flow, the boiler selector selects the plurality of boilers in the order of lower load factors when the determiner determines that the necessary steam flow is larger than the output steam flow, and the output controller increases the steam flow of the boiler selected by the boiler selector in accordance with the maximumly increased steam flow when the necessary steam flow is determined to be larger than the output steam flow.

Preferably, when the load factor of the boiler of which steam flow is increased exceeds the load factor of the boiler selected subsequently to the boiler of which steam flow is increased, the output controller increases the load factor of the boiler of which steam flow is increased so as to be equal to the load factor of the boiler having the second lowest load factor.

Preferably, the plurality of boilers has priority levels, the boiler selector preferentially selects the boiler of the higher priority level when at least two of the boilers have equal load factors, and the output controller increases the load factor of the selected boiler for an amount of the unit steam flow.

Preferably, the maximumly varied steam flow includes a maximumly decreased steam flow as an upper limit value of the steam flow possibly decreased per unit time, the determiner determines whether or not the necessary steam flow is smaller than the output steam flow, the boiler selector selects the plurality of boilers in the order of higher load factors when the necessary steam flow is determined to be smaller than the output steam flow, and the output controller decreases the steam flow of the boiler selected by the boiler selector in accordance with the maximumly decreased steam flow when the necessary steam flow is determined to be smaller than the output steam flow.

Preferably, when the load factor of the boiler of which steam flow is decreased is less than the load factor of the boiler selected subsequently to the boiler of which steam flow is decreased, the output controller decreases the load factor of the boiler of which steam flow is decreased so as to be equal to the load factor of the boiler having the second highest load factor.

Preferably, the plurality of boilers has priority levels, the boiler selector preferentially selects the boiler of the lower priority level when at least two of the boilers have equal load factors, and the output controller decreases the load factor of the selected boiler for an amount of the unit steam flow.

Preferably, the unit steam flow is set at 0.1% to 20% of a maximum steam flow of the boiler.

Effects of the Invention

The boiler system according to the present invention can equalize the load factors of the plurality of boilers ers without varying the steam flows of all the boilers each time a necessary steam flow varies.

DESCRIPTION OF EMBODIMENTS

A boiler system according to each preferred embodiment of the present invention will now be described with reference to the drawings.

Figure 1:
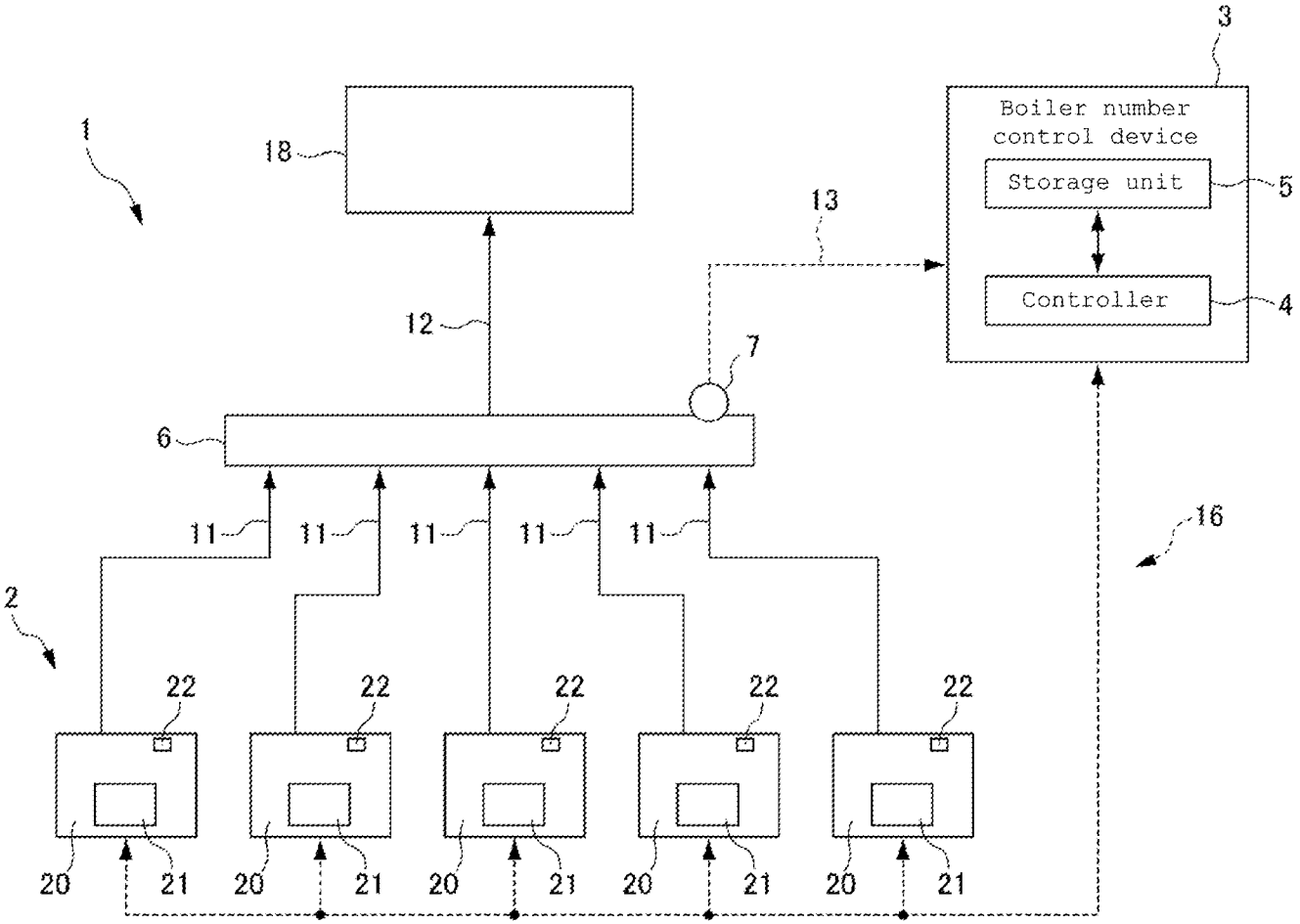
FIG. 1 is a schematic diagram of a boiler system according to an embodiment of the present invention.

A boiler system 1 according to the present invention is described initially with reference to FIG. 1.

The boiler system 1 includes a boiler group 2 having a plurality of (five) boilers 20, a steam header 6 for collecting steam generated by the plurality of boilers 20, a steam pressure sensor 7 for measuring internal pressure of the steam header 6, and a boiler number control device 3 having a controller 4 for controlling a combustion state of the boiler group 2.

The boiler group 2 generates steam to be supplied to a steam utilizing apparatus 18 serving as a loading machine.

The steam header 6 is connected, through a steam pipe 11, to each of the boilers 20 configuring the boiler group 2. The steam header 6 has a downstream end connected to the steam utilizing apparatus 18 through a steam pipe 12.

The steam header 6 collects and stores steam generated by the boiler group 2 to regulate relative pressure differences and pressure variations of the plurality of boilers 20 and supply pressure regulated steam to the steam utilizing apparatus 18.

The steam pressure sensor 7 is electrically connected to the boiler number control device 3 through a signal wire 13. The steam pressure sensor 7 measures internal steam pressure (pressure of steam generated by the boiler group 2) of the steam header 6 and transmits a signal on the measured steam pressure (steam pressure signal) to the boiler number control device 3 through the signal wire 13.

The boiler number control device 3 is electrically connected to each of the boilers 20 through a signal wire 16. The boiler number control device 3 controls the combustion state of each of the boilers 20 in accordance with the internal steam pressure of the steam header 6 measured by the steam pressure sensor 7. The boiler number control device 3 is to be detailed later.

The boiler system 1 thus configured can supply steam generated by the boiler group 2 to the steam utilizing apparatus 18 through the steam header 6.

A load required at the boiler system 1 (required load) corresponds to a consumed steam flow at the steam utilizing apparatus 18. The boiler number control device 3 calculates a variation of the internal steam pressure of the steam header 6 according to a variation of the consumed steam flow from the internal steam pressure (physical quantity) of the steam header 6 measured by the steam pressure sensor 7 to control a combustion amount of each of the boilers 20 configuring the boiler group 2.

Specifically, the required load (consumed steam flow) is increased by increase of a demand from the steam utilizing apparatus 18, and the internal steam pressure of the steam header 6 is decreased by shortage of a steam flow (output steam flow to be described later) supplied to the steam header 6. In contrast, the required load (consumed steam flow) is decreased by decrease of the demand from the steam utilizing apparatus 18, and the internal steam pressure of the steam header 6 is increased by excess of the steam flow supplied to the steam header 6. The boiler system 1 can monitor a variation of the required load according to the variation of the steam pressure measured by the steam pressure sensor 7. The boiler system 1 calculates a necessary steam flow from the steam pressure of the steam header 6. The necessary steam flow corresponds to a steam flow needed in accordance with a steam flow (required load) consumed by the steam utilizing apparatus 18.

The plurality of boilers 20 configuring the boiler system. 1 according to the present embodiment is described below.

As shown in FIG. 1, the boilers 20 each include a boiler body 21 for performing combustion, and a local controller 22 for controlling a combustion state of the corresponding boiler 20.

The local controller 22 changes the combustion state of the boiler 20 in accordance with a required load. Specifically, the local controller 22 controls the combustion state of the boiler 20 in accordance with a boiler number control signal transmitted from the boiler number control device 3 through the signal wire 16.

The local controller 22 also transmits a signal to be utilized by the boiler number control device 3, to the boiler number control device 3 through the signal wire 16. Examples of the signal utilized by the boiler number control device 3 include data on an actual combustion state of the boiler 20, and other data.

Figure 2:
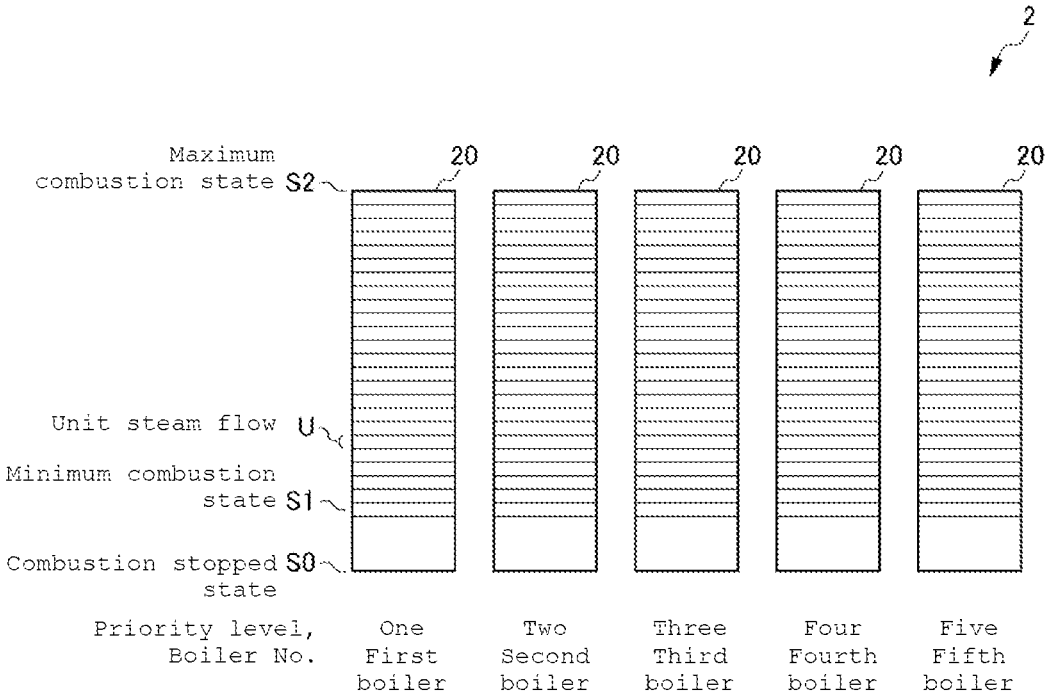
FIG. 2 is a schematic diagram of a boiler group according to an embodiment of the present invention.

FIG. 2 is a schematic diagram of the boiler group 2 according to the present embodiment. The boilers 20 according to the present embodiment are configured as proportional control boilers that can each combust with a continuously changed load factor.

A proportional control boiler has a combustion amount that can be controlled continuously at least in a range from a minimum combustion state S1 (e.g. a combustion state with a combustion amount corresponding to 20% of a maximum combustion amount) to a maximum combustion state S2. The combustion amount of the proportional control boiler is regulated by control of a valve used for supplying fuel to a burner or an opening degree of a damper used for supplying combustion air (combustion ratio).

Continuous control of a combustion amount includes a case where output from the boiler 20 (combustion amount) can be controlled actually continuously even when the local controller 22 performs calculation or utilizes a signal digitally and in a stepwise manner (e.g. when the output is controlled by the percentage.)

According to the present embodiment, a change of the combustion state between a combustion stopped state S0 and the minimum combustion state S1 of the boiler 20 is controlled by performing/stopping combustion of the boiler 20 (burner). The combustion amount can be controlled continuously in the range from the minimum combustion state S1 to the maximum combustion state S2.

More specifically, each of the boilers 20 has a unit steam flow U, which is set as the unit of a variable steam flow. The steam flow of each of the boilers 20 can be thus changed by the unit steam flow U in the range from the minimum combustion state S1 to the maximum combustion state S2.

The unit steam flow U can be set appropriately in accordance with the steam flow in the maximum combustion state S2 (maximum steam flow) of the boiler 20. In order for improvement in followability of an output steam flow to a necessary steam flow in the boiler system 1, the unit steam flow U is set preferably at 0.1% to 20% of the maximum steam flow of the boiler 20 and more preferably at 1% to 10% thereof. Also for the improvement, the unit steam flow U is preferably set at 20 kg/h to 200 kg/h when the boiler weighs 2*t* and the maximum steam flow thereof is 2000 kg/h.

An output steam flow corresponds to a steam flow outputted from the boiler group 2 and is obtained as the sum of the steam flows outputted from the plurality of boilers 20.

Each of the boilers 20 has a maximumly varied steam flow, which is set as an upper limit value of the steam flow variable per unit time. The maximumly varied steam flow according to the present embodiment is set as the upper limit value of the steam flow varied in a second. The maximumly varied steam flow is set to a value equal to an integral multiple of the unit steam flow U.

The maximumly varied steam flow thus set includes a maximumly increased steam flow as an upper limit value of a steam flow that can be increased per unit time and a maximumly decreased steam flow as an upper limit value of a steam flow that can be decreased per unit time.

Furthermore, the plurality of boilers 20 has respective priority levels. The priority level is utilized for selection of the boiler 20 that receives a combustion command or a combustion stop command. The priority level is set with an integer value such that a smaller value indicates a higher priority level. As shown in FIG. 2, when the boilers 20 include first to fifth boilers that have the priority levels of "one" to "five", respectively, the first boiler has the highest priority level whereas the fifth boiler has the lowest priority level. These priority levels are normally controlled by the controller 4 to be described later and are changed at predetermined time intervals (e.g. every 24 hours).

The boiler group 2 thus configured has a predeterminedly set combustion pattern. According to an exemplary combustion pattern of the boiler group 2, the boiler 20 of the highest priority level is combusted and the boiler 20 of the second highest priority level is combusted when the load actor of the combusting boiler 20 exceeds a predetermined threshold.

Described in detail next is control of the combustion states of the plurality of boilers 20 configuring the boiler system 1 according to the present embodiment.

The boiler number control device 3 calculates, from a steam pressure signal transmitted from the steam pressure sensor 7, a necessary combustion amount of the boiler group 2 according to the required load and a combustion state of each of the boilers 20 associated with the necessary combustion amount, and transmits a boiler number control signal to each of the boilers 20 (local controllers 22). As shown in gig. 1, the boiler number control device 3 includes a storage unit 5 and the controller 4.

The storage unit 5 stores information on the content of a command issued to each of the boilers 20 according to control of the boiler number control device 3 (controller 4) or a combustion state received from each of the boilers 20, information such as a setting condition of the combustion pattern of the boilers 20, information on the unit steam flow U set to the boilers 20, setting information on the maximumly varied steam flows of the boilers 20, setting information on the priority levels of the boilers 20, setting information on changes of the priority levels (rotation), and the like.

The controller 4 controls the combustion states and the priority levels of the five boilers 20 by issuing various commands to the boilers 20 through the signal wire 16 and receiving various data from the boilers 20. The boilers 20 are controlled in accordance with a command signal for a change of a combustion state received from the boiler number control device 3.

Figure 3:
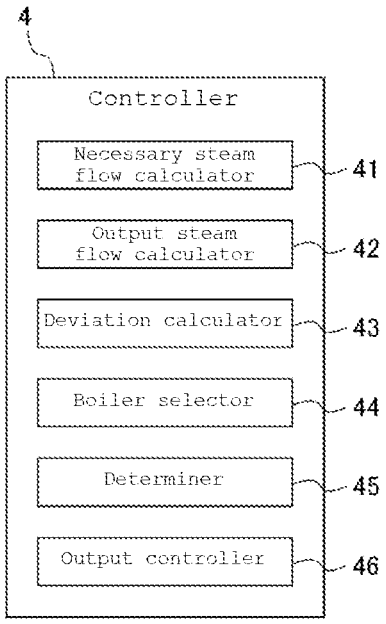
FIG. 3 is a functional block diagram showing a configuration of a controller.

FIG. 3 is a functional block diagram showing a configuration of the controller 4. The controller 4 according to the present embodiment selects one of the boilers 20 of which load factor is to be varied in accordance with the load factors of the boilers 20 when the required load is varied. In this case, the controller 4 varies the load factor of the selected boiler 20 by the unit steam flow U. The controller 4 further selects another one of the boilers 20 as necessary in accordance with the steam flow to be varied and the maximumly varied steam flow of the boiler 20 of which load factor is varied. In this case, the controller 4 varies the load factor of the other boiler 20 thus selected by the unit steam flow U.

In order to achieve these functions, the controller 4 includes a necessary steam flow calculator 41, an output steam flow calculator 42, a deviation calculator 43, a boiler selector 44, a determiner 45, and an output controller 46.

The necessary steam flow calculator 41 calculates a necessary steam flow according to the required load from the steam pressure of the steam header 6.

The output steam flow calculator 42 calculates an output steam flow as a steam flow to be outputted from the boiler group 2, from the combustion states of the boilers 20 transmitted from the local controllers 22.

The deviation calculator 43 calculates a deviation amount between the necessary steam flow and the output steam flow.

The boiler selector 44 selects one of the boilers 20 of which steam flow is to be changed when the necessary steam flow varies. Specifically, the boiler selector 44 selects some of the boilers 20 in the order of lower or higher load factors. More particularly, the boiler selector 44 selects some of the boilers in the order of lower load factors when the necessary steam flow is larger than the output steam flow. In contrast, the boiler selector 44 selects some of the boilers in the order of higher load factors when the necessary steam flow is smaller than the output steam flow.

In a case where at least two of the boilers 20 have equal load factors, the boiler selector 44 preferentially selects the boiler 20 of the higher priority level when the necessary steam flow is larger than the output steam flow, and preferentially selects the boiler 20 of the lower priority level when the necessary steam flow is smaller than the output steam flow.

The determiner 45 determines whether or not the deviation amount calculated by the deviation calculator 43 is not less than the unit steam flow U. The determiner 45 also determines whether or not the deviation amount is not less than the maximumly varied steam flow. The determiner 45 further determines whether the necessary steam flow is larger or smaller than the output steam flow.

When the determiner 45 determines that the deviation amount is not less than the maximumly varied steam flow, the output controller 46 varies the steam flow of the boiler 20 selected first by the boiler selector 44 by the unit steam flow U for an amount corresponding to the maximumly varied steam flow. In this case, the output controller 46 varies the steam flow of the boiler 20 selected subsequently to the first selected boiler 20 by the unit steam flow U for an amount corresponding to the difference between the deviation amount and the maximumly varied steam flow.

More specifically, when the determiner 45 determines that the necessary steam flow is larger than the output steam flow, the maximumly varied steam flow corresponds to the maximumly increased steam flow. In this case, the output controller 46 initially increases the steam flow of the boiler 20 selected first by the boiler selector 44 by the unit steam flow U for the amount of the maximumly increased steam flow. The output controller 46 then increases the steam flow of the boiler 20 selected subsequently to the first selected boiler 20 by the unit steam flow U for an amount corresponding to the difference between the deviation amount and the maximumly varied steam flow.

In contrast, when the determiner 45 determines that the necessary steam flow is smaller than the output steam flow, the maximumly varied steam flow corresponds to the maximumly decreased steam flow. In this case, the output controller 46 initially decreases the steam flow of the boiler 20 selected first by the boiler selector 44 by the unit steam flow U for the amount of the maximumly decreased steam flow. The output controller 46 then decreases the steam flow of the boiler 20 selected subsequently to the first selected boiler 20 by the unit steam flow U for an amount corresponding to the difference between the deviation amount and the maximumly decreased steam flow.

When the determiner 45 determines that the deviation amount is smaller than the maximumly varied steam flow, the output controller 46 varies the steam flow of the boiler 20 selected by the boiler selector 44 by the unit steam flow U for an amount corresponding to the deviation amount.

More specifically, when the determiner 45 determines that the necessary steam flow is larger than the output steam flow in this case, the output controller 46 increases the steam flow of the boiler 20 selected by the boiler selector 44 by the unit steam flow U for an amount corresponding to the deviation amount. When the determiner 45 determines that the necessary steam flow is smaller than the output steam flow, the output controller 46 decreases the steam flow of the boiler 20 selected by the boiler selector 44 by the unit steam flow U for an amount corresponding to the deviation amount.

In order to perform the control described above, when the load factor of the boiler 20 of which steam flow is increased exceeds the load factor of the boiler 20 selected subsequently to this boiler 20, the output controller 46 initially increases the load factor of the boiler 20 of which steam flow is increased the first selected boiler 20) so as to be equal to the load factor of the boiler 20 having the second lowest load factor (e.g. the second selected boiler 20) In this case, the controller 4 calculates a deviation residual amount that is obtained by subtracting the steam flow corresponding to the increased load factor from the deviation amount.

The boiler selector 44 then selects the boiler 20 of the higher priority level out of the boilers 20 having the equal load factors. The output controller 46 increases the load factor of the selected boiler 20 for the amount of the unit steam flow U. The controller 4 decreases the deviation residual amount for the amount of the unit steam flow U. The boiler selector 44 then selects the boiler 20 of the lower load factor. The output controller 46 increases the load factor of the selected boiler 20 for the amount of the unit steam flow U. The controller 4 decreases the deviation residual amount again for the amount of the unit steam flow U. Similar control is repeated until the deviation residual amount is decreased so as to be smaller than the unit steam flow U.

When the load factor of the boiler 20 of which steam flow is decreased is lower than the load factor of the boiler 20 selected subsequently to this boiler 20, the output controller 46 initially decreases the load factor of the boiler 20 of which steam flow is decreased (e.g. the first selected boiler 20) so as to be equal to the load factor of the boiler 20 having the second highest load factor (e.g. the second selected boiler 20) In this case, the controller 4 calculates a deviation residual amount that is obtained by subtracting the steam flow corresponding to the decreased load factor from the deviation amount.

The boiler selector 44 then selects the boiler 20 of the lower priority level out of the boilers 20 having the equal load factors. The output controller 46 decreases the load factor of the selected boiler 20 for the amount of the unit steam flow U. The controller 4 decreases the deviation residual amount for the amount of the unit steam flow U. The boiler selector 44 then selects the boiler 20 of the higher load factor. The output controller 46 decreases the load factor of the selected boiler 20 for the amount of the unit steam flow U. The controller 4 decreases the deviation residual amount again for the amount of the unit steam flow U. Similar control is repeated until the deviation residual amount is decreased so as to be smaller than the unit steam flow U.

The control described above is performed at predetermined time intervals (e.g. every one minute) in the present embodiment.

A specific example of operation of the boiler system 1 according to the present embodiment is described next with reference to FIGS. 4 to 10(*d*).

Initially described with reference to FIGS. 4 to 7(*c*) is operation of the boiler system 1 in a state where the required load is increased (where the necessary steam flow is increased).

Figure 4:
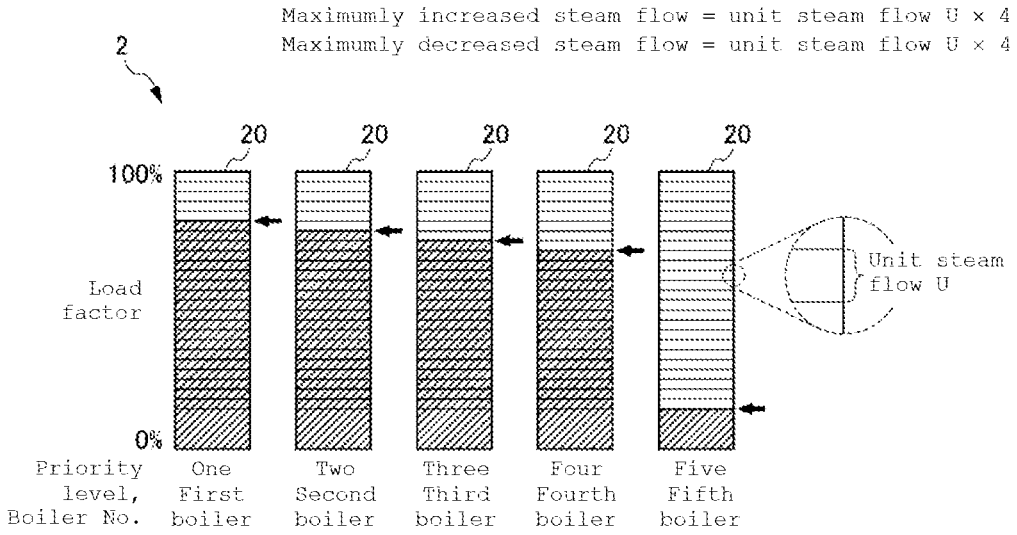
FIG. 4 is a diagram exemplifying a combustion state of the boiler group.

As shown in FIG. 4, the boiler system 1 has the boiler group 2 including the five boilers 20. The unit steam flow U of the boilers 20 is set so as to correspond to a single scale indicated in FIG. 4. The maximumly increased steam flow and the maximumly decreased steam flow of the respective boilers 20 are each set to four times of the unit steam flow. The first to fifth boilers 20 have the priority levels of "one" to "five", respectively.

Described below is operation of the boiler system 1 that includes the five boilers 20 combusting respectively at the load factors indicated in FIG. 4 when the necessary steam flow is increased for an amount corresponding to the deviation amount equal to seven times of the unit steam flow U per unit time (one second).

Figure 5:
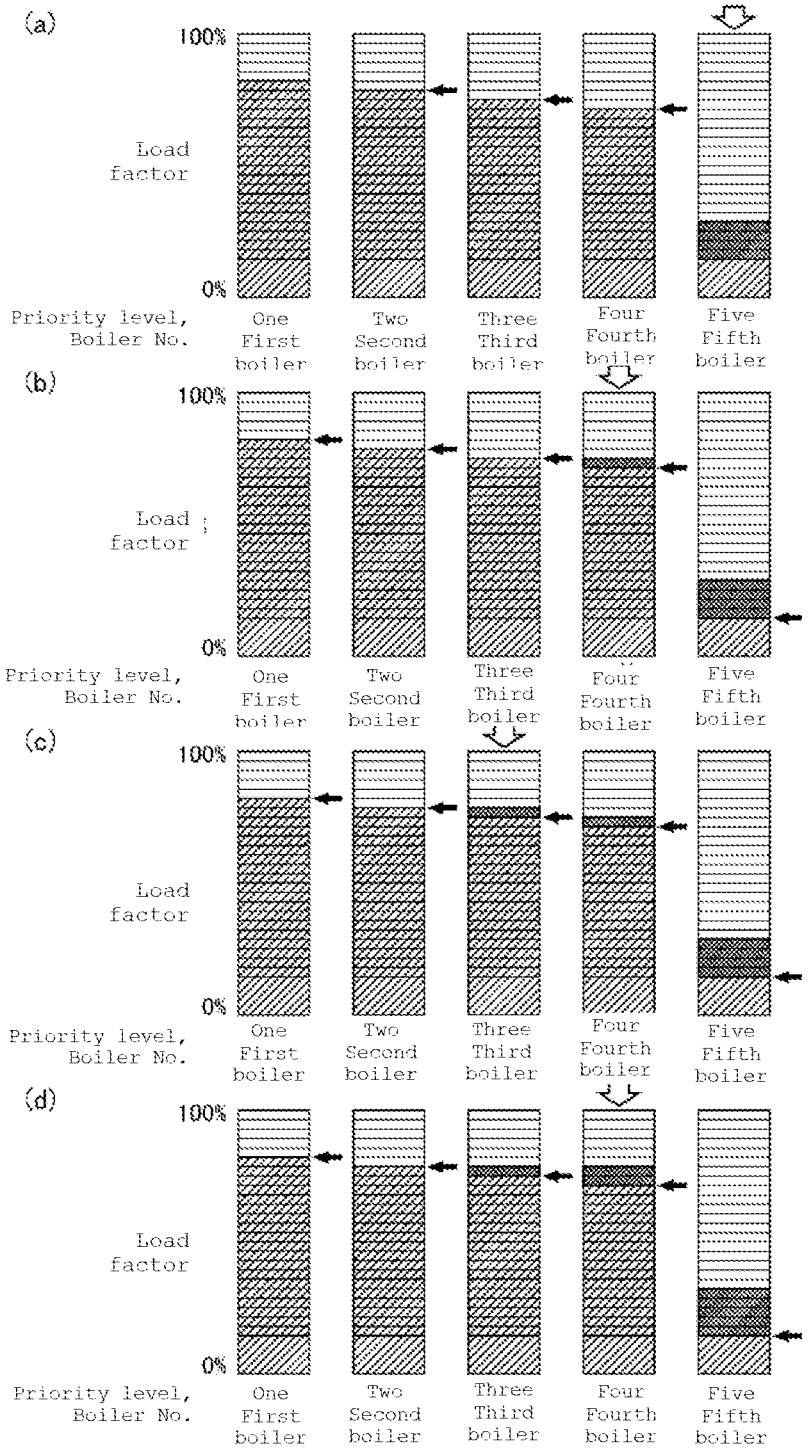
FIGS. 5(*a*) to 5(*d*) are views exemplifying operation of the boiler system when a necessary steam flow increases.

Operation of the boiler system 1 during the first second is described initially with reference to FIGS. 5(*a*) to 5(*d*).

In this case, the controller 4 (determiner 45) initially determines that the necessary steam flow is larger than the output steam flow and the deviation amount (the unit steam flow U×7) is larger than the unit steam flow U as well as is larger than the maximumly increased steam flow (the unit steam flow U×4).

The boiler selector 44 then selects the five boilers 20 in the order of lower load factors. The boiler selector 44 initially selects the fifth boiler 20 in this case.

As shown in FIG. 5(*a*), the output controller 46 then increases the load factor of the fifth boiler 20 for the amount of the unit steam flow U×4 corresponding to the maximumly increased steam flow. The controller 4 calculates the deviation residual amount (the unit steam flow U×3) which is obtained by subtracting the increased steam flow (the unit steam flow U×4) from the deviation amount (the unit steam flow U×7).

The boiler selector 44 then selects the fourth boiler 20 of the lowest load factor out of the four boilers 20 excluding the fifth boiler 20 of which load factor is increased for the amount of the maximumly increased steam flow. The output controller 46 increases the load factor of the fourth boiler 20.

If the load factor of the fourth boiler 20 is increased for the amount of the deviation residual amount (the unit steam flow U×3), the load factor of the fourth boiler 20 becomes higher than the load factor of the third boiler 20 of which load factor is second lowest to the load factor of the fourth boiler 20. The output controller 46 thus initially increases the load factor of the fourth boiler 20 so as to be equal to the load factor of the third boiler 20 of which load factor is the second lowest to the load factor of the fourth boiler 20. Specifically, as shown in FIG. 5(*b*), the output controller 46 increases the load factor of the fourth boiler 20 for the amount of the unit steam flow U×1. The controller 4 decreases the deviation residual amount for the amount of the increased steam flow (the unit steam flow U×1). The deviation residual amount is thus changed to the unit steam flow U×2.

The controller 4 (boiler selector 44) then selects the boiler of the lowest load factor out of the four boilers 20 excluding the fifth boiler 20 of which load factor is increased for the amount of the maximumly increased steam flow. The load factors of the third and fourth boilers 20 are equal in this case. The controller 4 thus preferentially selects the third boiler 20 of the higher priority level.

As shown in FIG. 5(*c*), the output controller 46 then increases the load factor of the third boiler 20 thus selected for the amount of the unit steam flow U. The controller 4 decreases the deviation residual amount for the amount of the increased steam flow (the unit steam flow U×1). The deviation residual amount is thus changed to the unit steam flow U×1.

The controller 4 (boiler selector 44) then selects the fourth boiler 20 of the lowest load factor out of the boilers 20 excluding the fifth boiler 20 from the five boilers 20. The load factor of the fifth boiler 20 is increased for the amount of the maximumly increased steam flow.

As shown in FIG. 5(*d*), the output controller 46 then increases the load factor of the fourth boiler 20 thus selected for the amount of the unit steam flow U. The controller 4 decreases the deviation residual amount for the amount of the increased steam flow (the unit steam flow U×1). The deviation residual amount thus becomes zero, and this is the end of the control for increasing the combustion amount.

Operation of the boiler system 1 during another second from the state shown in FIG. 5(*d*) is described next with reference to FIGS. 6(*a*) to 6(*d*).

The boiler selector 44 selects the five boilers 20 in the order of lower load factors in this case. The boiler selector 44 initially selects the fifth boiler 20 in this case.

Figure 6:
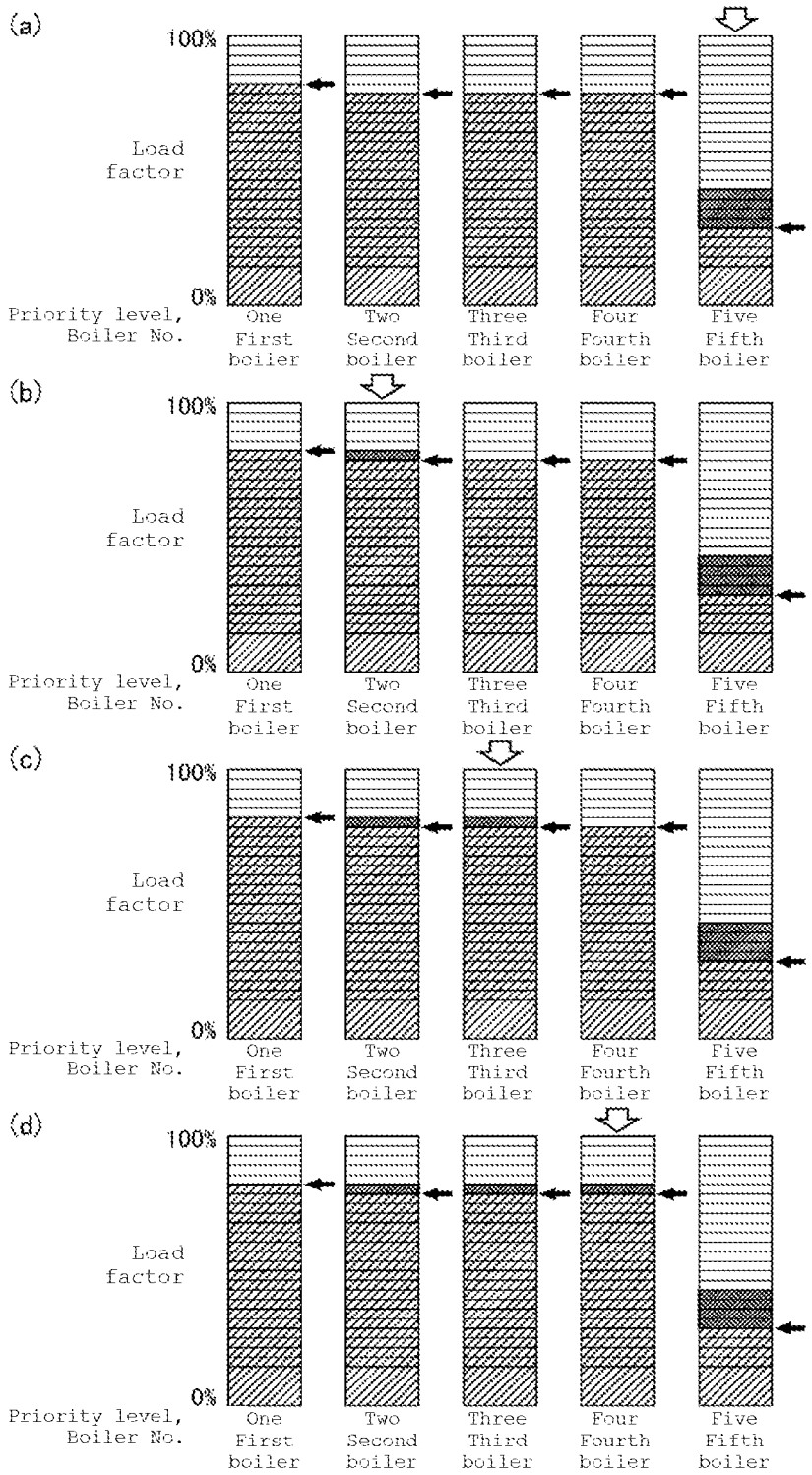
FIGS. 6(*a*) to 6(*d*) are views exemplifying operation of the boiler system when the necessary steam flow increases.

As shown in FIG. 6(*a*), the output controller 46 then increases the load factor of the fifth boiler 20 for the amount of the unit steam flow U×4 corresponding to the maximumly increased steam flow. The controller 4 calculates the deviation residual amount (the unit steam flow U×3) which is obtained by subtracting the increased steam flow (the unit steam flow U×4) from the deviation amount (the unit steam flow U×7).

The controller 4 (boiler selector 44) then selects the boiler of the lowest load factor out of the four boilers 20 excluding the fifth boiler 20 of which load factor is increased for the amount of the maximumly increased steam flow. The load factors of the second to fourth boilers 20 are equal in this case. The controller 4 thus preferentially selects the second boiler 20 of the highest priority level.

As shown in FIG. 6(*b*), the output controller 46 then increases the load factor of the second boiler 20 thus selected for the amount of the unit steam flow U. The controller 4 decreases the deviation residual amount for the amount of the increased steam flow (the unit steam flow U×1). The deviation residual amount is thus changed to the unit steam flow U×2.

The controller 4 (boiler selector 44) then selects the boiler of the lowest load factor out of the boilers 20 excluding the fifth boiler 20. The load factors of the third and fourth boilers 20 are equal in this case. The controller 4 thus preferentially selects the third boiler 20 of the higher priority level.

As shown in FIG. 6(*c*), the output controller 46 then increases the load factor of the third boiler 20 thus selected for the amount of the unit steam flow U. The controller 4 decreases the deviation residual amount for the amount of the increased steam flow (the unit steam flow U×1). The deviation residual amount is thus changed to the unit steam flow U×1.

The controller 4 (boiler selector 44) then selects the fourth boiler 20 of the lowest load factor out of the boilers 20 excluding the fifth boiler 20. As shown in FIG. 6(*d*), the output controller 46 then increases the load factor of the fourth boiler 20 thus selected for the amount of the unit steam flow U. The controller 4 decreases the deviation residual amount for the amount of the increased steam flow (the unit steam flow U×1). The deviation residual amount thus becomes zero, and this is the end of the control for increasing the combustion amount.

Figure 7:
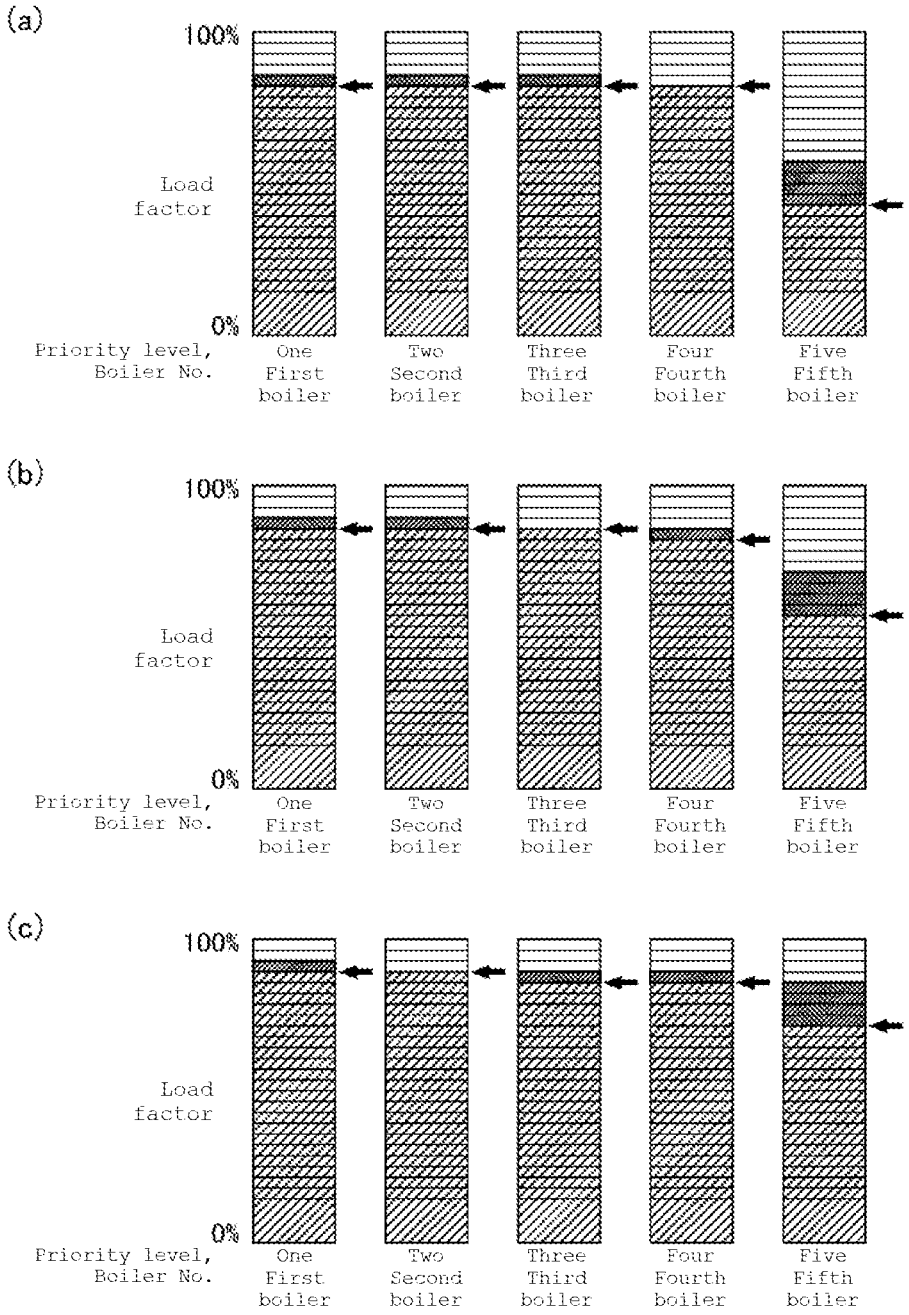
FIGS. 7(*a*) to 7(*c*) are views exemplifying operation of the boiler system when the necessary steam flow increases.

A change of the combustion state of the boiler system 1 during three seconds from the state shown in FIG. 6(*d*) is described, next with reference to FIGS. 7(*a*) to 7(*c*). FIG. 7(*a*) is a view showing the combustion state of the boiler group 2 one second after the state shown in FIG. 6(*d*). FIG. 7(*b*) is a view showing the combustion state of the boiler group 2 one second after the state shown in FIG. 7(*a*). FIG. 7(*c*) is a view showing the combustion state of the boiler group 2 one second after the state shown in FIG. 7(*b*).

As shown in FIGS. 7(*a*) to 7(*c*), the control described above causes the load factor of the fifth boiler 20 of the lowest load factor to approximate to the load factors of the first to fourth boilers 20 during three seconds from the state shown in FIG. 6(*d*).

When the necessary steam flow is larger than the output steam flow, the boiler 20 of the lowest load factor is selected in the boiler system 1 thus configured, and the load factor of the selected boiler 20 is increased by the unit steam flow U. When the deviation amount is not less than the maximumly increased steam flow, the load factor of the selected boiler 20 is increased for the amount of the maximumly increased steam flow and the deviation residual amount is caused to correspond to the requirement for increase of the combustion amount by increasing the load factor of another one of the boiler 20. In the state where one of the boilers 20 has a load factor much lower than the load factors of the other boilers 20, even when the deviation amount (the amount required for increase of the combustion amount) exceeds the maximumly increased steam flow of the boiler 20, the load factor of the boiler 20 having the lower load factor can be increased for the amount of the maximumly increased steam flow as well as the deviation residual amount can be caused to correspond to the requirement for increase of the combustion amount by increasing the load factor of another one of the boilers 20. Followability to a sudden variation of the required load can be thus improved and the plurality of boilers 20 can be combusted at uniformed load factors as time elapses. The boiler system can thus equalize the load factors of the plurality of boilers without varying the steam flows of all the boilers each time the necessary steam flow varies.

When the load factor of the boiler 20 of which steam flow is increased exceeds the load factor of the boiler 20 having the second lowest load factor, the output controller 46 increases the load factor of the boiler 20 of which the steam flow is increased so as to be equal to the load factor of the boiler 20 having the second lowest load factor. The boiler selector 44 then selects the boiler of the higher priority level out of the boilers 20 having the equal load factors. The output controller 46 increases the load factor of the selected boiler for the amount of the unit steam flow U. The plurality of boilers 20 can be thus combusted at more uniformed load factors.

Figure 8:
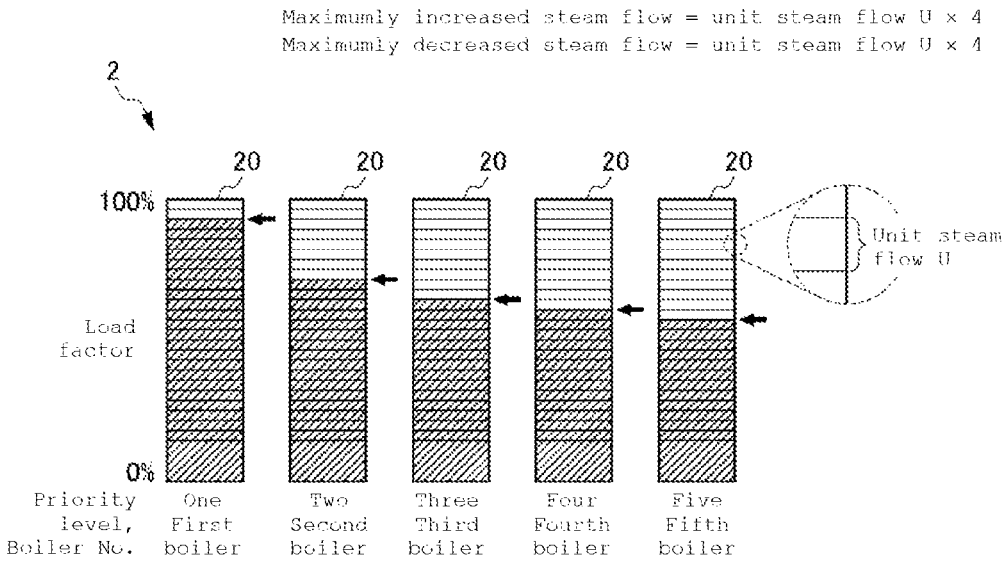
FIG. 8 is a diagram exemplifying a different combustion state of the boiler group.

Described next with reference to FIGS. 8 to 10(*d*) is operation of the boiler system 1 in a state where the required load is decreased (where the necessary steam flow is decreased).

Described below is operation of the boiler system 1 that has the boiler group 2 similar to that shown in FIG. 4 including the plurality of boilers 20 combusting respectively at the load factors indicated in FIG. 8 when the necessary steam flow is decreased for an amount corresponding to the deviation amount equal to seven times of the unit steam flow U per unit time (one second).

Figure 9:
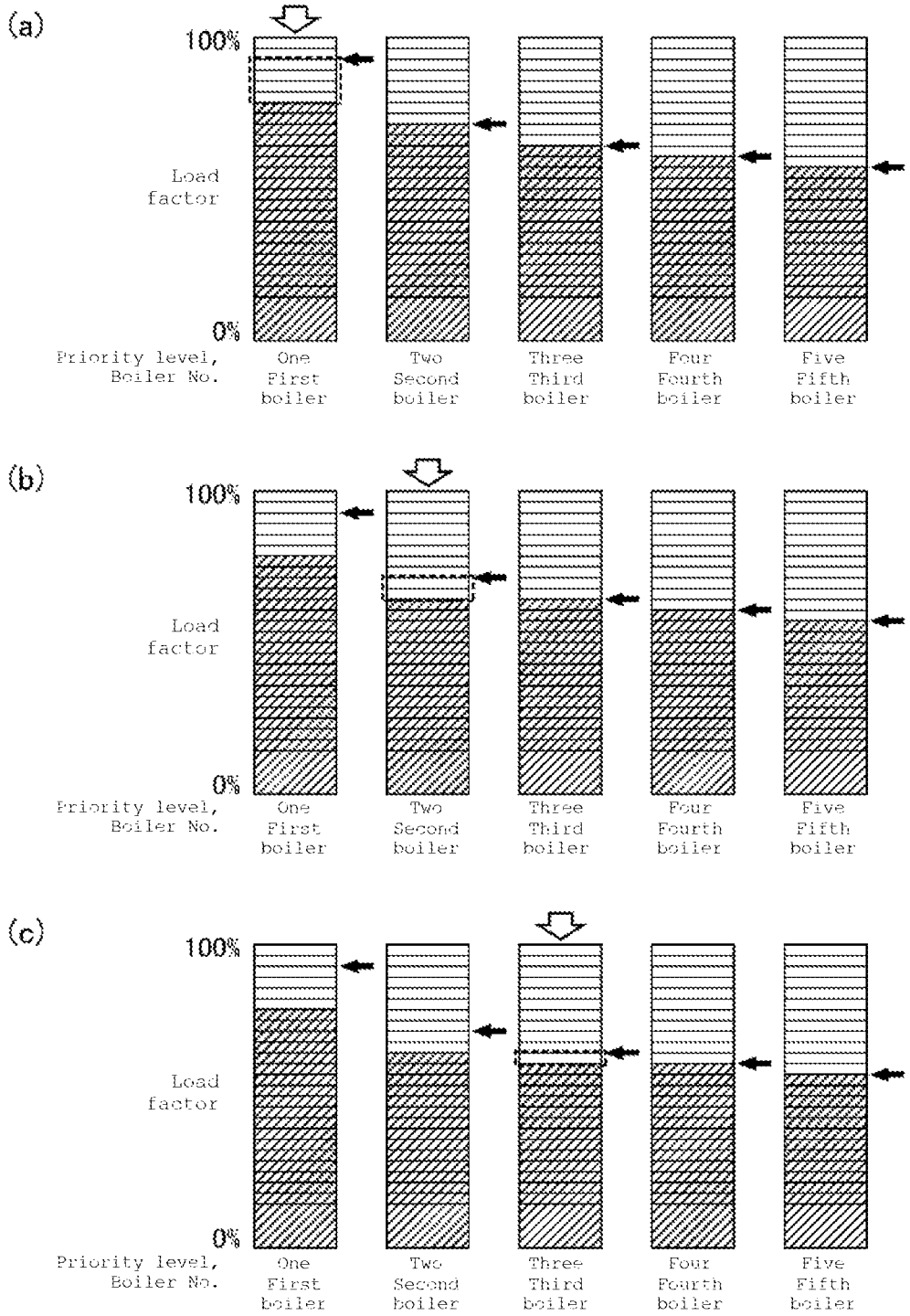
FIGS. 9(*a*) to 9(*c*) are views exemplifying different operation of the boiler system when the necessary steam flow decreases.

Operation of the boiler system 1 during the first second is described initially with reference to FIGS. 9(*a*) to 9(*c*).

In this case, the controller 4 (determiner 45) initially determines that the necessary steam flow is smaller than the output steam flow and the deviation amount (the unit steam flow U×7) is larger than the unit steam flow U as well as is larger than the maximumly decreased steam flow (the unit steam flow U×4).

The boiler selector 44 then selects the five boilers 20 in the order of higher load factors. The boiler selector 44 initially selects the first boiler 20 in this case.

As shown in FIG. 9(*a*), the output controller 46 then decreases the load factor of the first boiler 20 for the amount of the unit steam flow U×4 corresponding to the maximumly decreased steam flow. The controller 4 calculates the deviation residual amount (the unit steam flow U×3) which is obtained by subtracting the decreased steam flow (the unit steam flow U×4) from the deviation amount (the unit steam flow U×7).

The boiler selector 44 then selects the second boiler 20 of the highest load factor out of the four boilers 20 excluding the first boiler 20 of which load factor is decreased for the amount of the maximumly decreased steam flow. The output controller 46 increases the load factor of the second boiler 20.

If the load factor of the second boiler 20 is decreased for the amount of the deviation residual amount (the unit steam flow U×3), the load factor of the second boiler 20 becomes lower than the load factor of the third boiler 20 of which load factor is second highest to the load factor of the second boiler 20. The output controller 46 thus initially decreases the load factor of the second boiler 20 so as to be equal to the load factor of the third boiler 20 of which load factor is the second highest to the load factor of the second boiler 20. Specifically, as shown in FIG. 9(*b*), the output controller 46 decreases the load factor of the second boiler 20 for the amount of the unit steam flow U×2. The controller 4 decreases the deviation residual amount for the amount of the decreased steam flow (the unit steam flow U×2). The deviation residual amount is thus changed to the unit steam flow U×1.

The controller 4 (boiler selector 44) then selects the boiler of the highest load factor out of the four boilers 20 excluding the first boiler 20 of which load factor is decreased for the amount of the maximumly decreased steam flow. The load factors of the second and third boilers 20 are equal in this case. The controller 4 thus preferentially selects the third boiler 20 of the lower priority level.

As shown in FIG. 9(*c*), the output controller 46 then decreases the load factor of the third boiler 20 thus selected for the amount of the unit steam flow U. The controller 4 decreases the deviation residual amount for the amount of the decreased steam flow (the unit steam flow U×1) The deviation residual amount thus becomes zero, and this is the end of the control for decreasing the combustion amount.

Operation of the boiler system 1 during another second from the state shown in FIG. 9(*c*) is described next with reference to FIGS. 10(*a*) to 10(*d*).

The boiler selector 44 selects the five boilers 20 in the order of higher load factors in this case. The boiler selector 44 initially selects the first boiler 20 in this case.

Figure 10:
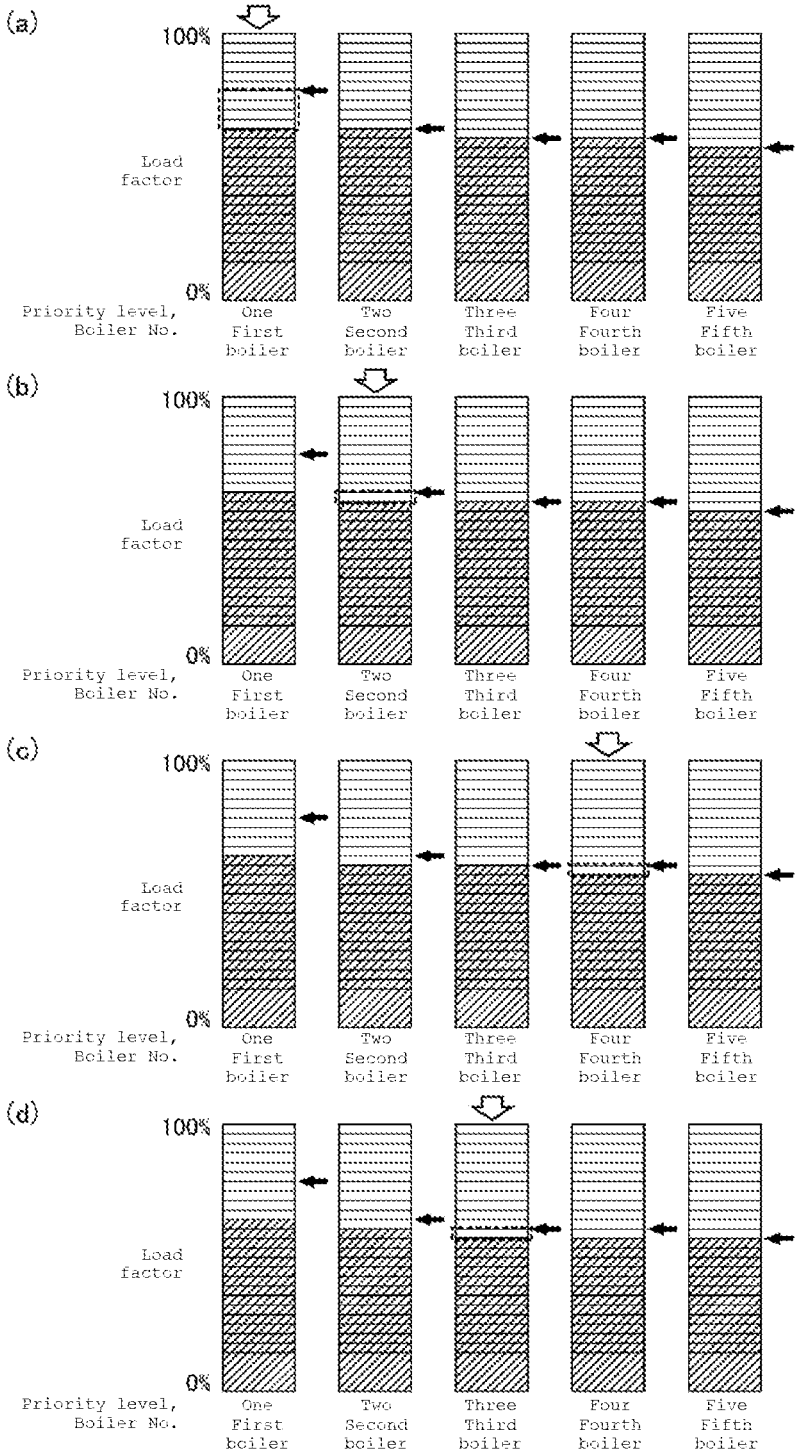
FIGS. 10(*a*) to 10(*d*) are views exemplifying different operation of the boiler system when the necessary steam flow decreases.

As shown in FIG. 10(*a*), the output controller 46 then decreases the load factor of the first boiler 20 for the amount of the unit steam flow U×4 corresponding to the maximumly decreased steam flow. The controller 4 calculates the deviation residual amount (the unit steam flow U×3) which is obtained by subtracting the decreased steam flow (the unit steam flow U×4) from the deviation amount (the unit steam flow U×7).

The boiler selector 44 then selects the second boiler 20 of the highest load factor out of the four boilers 20 excluding the first boiler 20 of which load factor is decreased for the amount of the maximumly decreased steam flow. The output controller 46 decreases the load factor of the second boiler 20.

If the load factor of the second boiler 20 is decreased for the amount of the deviation residual amount (the unit steam flow U×3), the load factor of the second boiler 20 becomes lower than the load factor of the third boiler 20 of which load factor is second highest to the load factor of the second boiler 20. The output controller 46 thus initially decreases the load factor of the second boiler 20 so as to be equal to the load factor of the third boiler 20 of which load factor is the second highest to the load factor of the second boiler 20. Specifically, as shown in FIG. 10(*b*), the output controller 46 decreases the load factor of the second boiler 20 for the amount of the unit steam flow U×1. The controller 4 decreases the deviation residual amount for the amount of the decreased steam flow (the unit steam flow U×1) The deviation residual amount is thus changed to the unit steam flow U×2.

The controller 4 (boiler selector 44) then selects the boiler 20 of the highest load factor out of the four boilers 20 excluding the first boiler 20 of which load factor is decreased for the amount of the maximumly decreased steam flow. The load factors of the second to fourth boilers 20 are equal in this case. The controller 4 thus preferentially selects the fourth boiler 20 of the lowest priority level.

As shown in FIG. 10(*c*), the output controller 46 then decreases the load factor of the fourth boiler 20 thus selected for the amount of the unit steam flow U. The controller 4 decreases the deviation residual amount for the amount of the decreased steam flow (the unit steam flow U×1). The deviation residual amount is thus chanced to the unit steam flow U×1.

The controller 4 (boiler selector 44) then selects the boiler of the highest load factor out of the boilers 20 excluding the first boiler 20. The load factors of the second and third boilers 20 are equal in this case. The controller 4 thus preferentially selects the third boiler 20 of the lower priority level.

As shown in FIG. 10(*d*), the output controller 46 then decreases the load factor of the third boiler 20 thus selected for the amount of the unit steam flow U. The controller 4 decreases the deviation residual amount for the amount of the decreased steam flow (the unit steam flow U×1). The deviation residual amount thus becomes zero, and this is the end of the control for decreasing the combustion amount.

Similarly to the case where the necessary steam flow is increased, also in the case where the necessary steam flow is decreased in the boiler system 1 according to the present embodiment, followability to a sudden variation of the required load can be improved and the plurality of boilers 20 can be combusted at uniformed load factors as time elapses.

The boiler system 1 according to the preferred embodiment of the present invention is described above. The present invention is not limited to this embodiment but can be modified where appropriate.

For example, the present invention is applied to the boiler system provided with the boiler group 2 including the five boilers 20 according to the present embodiment. The present invention is not limited this case. Specifically, the present invention is applicable to a boiler system provided with a boiler group including six or more boilers. The present invention is also applicable to a boiler system provided with a boiler group including four or less boilers.

The boilers 20 according to the present embodiment are configured as proportional control boilers 20 such that the change of the combustion state of the each of the boilers 20 between the combustion stopped state S0 and the minimum combustion state S1 is controlled by performing/stopping combustion of the boiler 20 and the combustion amount can be controlled continuously in the range from the minimum combustion state S1 to the maximum combustion state S2. The present invention is not limited to this case. Specifically, the boilers can be each configured as a proportional control boiler such that the combustion amount can be controlled continuously in the entire range from the combustion stopped state the maximum combustion state.

The output steam flow of the boiler group 2 corresponds to the sum of the steam flows outputted from the plurality of boilers 20 in the present embodiment. The present invention is not limited to this case. Specifically, the output steam flow of the boiler group 2 can alternatively correspond to the sum of commanded steam flows as steam flows calculated from combustion command signals transmitted from the boiler number control device 3 (controller 4) to the plurality of boilers 20.

The boiler system 1 according to the present embodiment includes the boilers 20 that have equal properties (i.e. the maximum steam flow, the unit steam flow U, the maximumly increased steam flow, and the maximumly decreased steam flow of the boiler). The present invention is not limited to this Case. Specifically, the boiler system can include a plurality of boilers having different properties (e.g. a plurality of boilers having different maximum steam flows).

REFERENCE SIGN LIST

1 Boiler system
2 Boiler group
4 Controller
20 Boiler
44 Boiler selector
45 Determiner
46 Output controller
U Unit steam flow

The invention claimed is:

1. A boiler system comprising:

a boiler group including a plurality of boilers configured to combust at continuously changing load factors, and a controller for controlling a combustion state of the boiler group in accordance with a required load, wherein each of the boilers has a unit amount of steam and a maximum variable amount of steam, the unit amount of steam being set as a unit of a variable amount of steam and the maximum variable amount of steam being set as an upper limit value of the variable amount of steam per unit time, where the upper limit value is set as a multiple which is generated by multiplying the unit amount of steam by a whole number, and the controller includes:

a deviation calculator configured to calculate a deviation amount between a necessary amount of steam required in accordance with the required load and an output amount of steam outputted from the boiler group, a boiler selector configured to select the plurality of boilers in an order from lowest to highest or from highest to lowest load factors, a determiner configured to determine whether or not the deviation amount is equal to or larger than the maximum variable amount of steam, and an output controller configured to vary an amount of steam produced by each of the plurality of boilers selected by the boiler selector, wherein the output controller is configured to vary an amount of steam of a boiler selected first by the boiler selector by the maximum variable amount of steam for the deviation amount when the output controller receives from the determiner a signal indicating that the deviation amount is equal to or larger than the maximum variable amount of steam, and the output controller is configured to vary the amount of steam of the first selected boiler by the unit amount of steam for the deviation amount when the output controller receives from the determiner a signal indicating that the deviation amount is less than the maximum variable amount of steam.

2. The boiler system according to claim 1, wherein when the determiner determines that the deviation amount is equal to or larger than the maximum variable amount of steam, and the output controller determines a difference between the deviation amount and the maximum variable amount of steam, the controller varies an amount of steam from a boiler selected subsequently to the first selected boiler by the unit amount of steam for the difference.

3. The boiler system according to claim 1, wherein the maximum variable amount of steam includes a maximally increasable amount of steam as an upper limit value at which an amount of steam is increasable per unit time, the determiner determines whether or not the necessary amount of steam is larger than the output amount of steam, the boiler selector selects the plurality of boilers in an order from lowest to highest load factors when the determiner determines that the necessary amount of steam is larger than the output amount of steam, and the output controller increases the amount of steam of the boiler selected by the boiler selector in accordance with the maximally increasable amount of steam when the necessary amount of steam is determined to be larger than the output amount of steam.

4. The boiler system according to claim 3, wherein when the load factor of the boiler of which the amount of steam is increased exceeds the load factor of a second boiler which is selected subsequently, the output controller increases the load factor of the boiler of which the amount of steam is increased, until its load factor is equal to the load factor of the second boiler.

5. The boiler system according to claim 4, wherein the plurality of boilers have priority levels, the boiler selector selects a boiler of a higher priority level when at least two of the boilers have equal load factors, and the output controller increases a load factor of the selected boiler by the unit amount of steam.

6. The boiler system according to claim 5, wherein the maximum variable amount of steam includes a maximally decreasable amount of steam as a lower limit value per unit time, the determiner determines whether or not the necessary amount of steam is smaller than the output amount of steam, the boiler selector selects the plurality of boilers in an order from highest to lowest load factors when the necessary amount of steam is determined to be smaller than the output amount of steam, and the output controller decreases the amount of steam of the boiler selected by the boiler selector in accordance with the maximally decreasable amount of steam when the necessary amount of steam is determined to be smaller than the output amount of steam.

7. The boiler system according to claim 6, wherein when the load factor of the boiler of which the amount of steam is decreased is less than the load factor of a second boiler which is selected subsequently, the output controller decreases the load factor of the boiler of which the amount of steam is decreased, until its load factor is equal to the load factor of the second boiler.

8. The boiler system according to claim 7, wherein the plurality of boilers have priority levels, the boiler selector selects a boiler of a lower priority level when at least two of the boilers have equal load factors, and the output controller decreases a load factor of the selected boiler by the unit amount of steam.

9. The boiler system according to claim 8, wherein the unit amount of steam is set at 0.1% to 20% of a maximum amount of steam of the selected boiler.

10. The boiler system according to claim 2, wherein the maximum variable amount of steam includes a maximally increasable amount of steam as an upper limit value per unit time, the determiner determines whether or not the necessary amount of steam is larger than the output amount of steam, the boiler selector selects the plurality of boilers in an order from lowest to highest load factors when the determiner determines that the necessary amount of steam is larger than the output amount of steam, and the output controller increases the amount of steam of the boiler selected by the boiler selector in accordance with the maximally increasable amount of steam when the necessary amount of steam is determined to be larger than the output amount of steam.

11. The boiler system according to claim 10, wherein when the load factor of the boiler of which the amount of steam is increased exceeds the load factor of a second boiler which is selected subsequently, the output controller increases the load factor of the boiler of which the amount of steam is increased, until its load factor is equal to the load factor of the second boiler.

12. The boiler system according to claim 11, wherein the plurality of boilers have priority levels, the boiler selector selects a boiler of a higher priority level when at least two of the boilers have equal load factors, and the output controller increases a load factor of the selected boiler by the unit amount of steam.

13. The boiler system according to claim 12, wherein the maximum variable amount of steam includes a maximally decreasable amount of steam as a lower limit value per unit time, the determiner determines whether or not the necessary amount of steam is smaller than the output amount of steam, the boiler selector selects the plurality of boilers in an order from highest to lowest load factors when the necessary amount of steam is determined to be smaller than the output amount of steam, and the output controller decreases the amount of steam of the boiler selected by the boiler selector in accordance with the maximally decreasable amount of steam when the necessary amount of steam is determined to be smaller than the output amount of steam.

14. The boiler system according to claim 13, wherein when the load factor of the boiler of which an amount of steam is decreased is less than the load factor of a second boiler which is selected subsequently, the output controller decreases the load factor of the boiler of which the amount of steam is decreased, until its load factor is equal to the load factor of the second boiler.

15. The boiler system according to claim 14, wherein the plurality of boilers have priority levels, the boiler selector selects a boiler of a lower priority level when at least two of the boilers have equal load factors, and the output controller decreases a load factor of the selected boiler by the unit amount of steam.

16. The boiler system according to claim 15, wherein the unit amount of steam is set at 0.1% to 20% of a maximum amount of steam of the selected boiler.

17. A method for controlling the boiler system of claim 1, comprising the steps of:

calculating a deviation amount between a necessary amount of steam required in accordance with the required load and an output amount of steam outputted from the boiler group;

selecting the plurality of boilers in an order from lowest to highest or from highest to lowest load factors;

determining whether or not the deviation amount is equal to or larger than the maximum variable amount of steam; and varying an amount of steam produced by each of the plurality of boilers selected in the selecting step, wherein an amount of steam of a boiler selected first in the selecting step is varied in the varying step by the maximum variable amount of steam for the deviation amount when the deviation amount is determined, in the determining step, to be equal to or larger than the maximum variable amount of steam, and the amount of steam of the first selected boiler is varied in the varying step by the unit amount of steam for the deviation amount when the deviation amount is determined, in the determining step, to be less than the maximum variable amount of steam.

* * * * *